United States Patent [19]

Burnett

[11] Patent Number: 4,544,096

[45] Date of Patent: Oct. 1, 1985

[54] ELECTRONICALLY CONTROLLED FUEL INJECTION SYSTEM FOR DIESEL ENGINE

[75] Inventor: Lauren W. Burnett, Blue Springs, Mo.

[73] Assignee: Energy Conservation Innovations, Inc., Bates City, Mo.

[21] Appl. No.: 517,944

[22] Filed: Jul. 28, 1983

[51] Int. Cl.[4] ..... F02M 47/02

[52] U.S. Cl. ..... 239/92; 239/88; 239/585

[58] Field of Search ..... 239/90–92, 239/533.8, 585, 88, 89; 123/447

[56] References Cited

U.S. PATENT DOCUMENTS

| | | | |
|---|---|---|---|
| 1,589,239 | 6/1926 | Scoff | 239/533.6 |
| 2,055,580 | 9/1936 | Larsson et al. | 239/91 |
| 3,796,206 | 3/1974 | Links | 123/139 E |
| 3,837,324 | 9/1974 | Links | 123/139 E |
| 3,913,537 | 10/1975 | Ziesche et al. | 123/32 AE |
| 4,046,112 | 9/1977 | Deckard | 123/32 JV |
| 4,128,254 | 12/1978 | Bader, Jr. et al. | 239/96 |
| 4,164,203 | 8/1979 | •Cavanaugh | 239/585 |
| 4,185,779 | 1/1980 | Watson | 123/342 |
| 4,197,996 | 4/1980 | Giardini | 239/87 |
| 4,217,862 | 8/1980 | Fort et al. | 123/472 |
| 4,219,154 | 8/1980 | Luscomb | 239/91 |
| 4,235,374 | 11/1980 | Walter et al. | 239/90 |
| 4,258,674 | 3/1981 | Wolff | 123/446 |
| 4,275,693 | 6/1981 | Leckie | 123/447 |
| 4,437,443 | 3/1984 | Hofbauer | 239/92 X |
| 4,462,368 | 7/1984 | Funada | 123/447 X |

FOREIGN PATENT DOCUMENTS

| | | | |
|---|---|---|---|
| 2098673 | 11/1982 | United Kingdom | 239/92 |

*Primary Examiner*—Andres Kashnikow
*Assistant Examiner*—Kevin Patrick Weldon
*Attorney, Agent, or Firm*—Schmidt, Johnson, Hovey & Williams

[57] ABSTRACT

An electronically controlled, microprocessor equipped fuel injection system for new manufacture or retrofit of existing diesel engines has a tubular injector provided with a fuel pressure amplification chamber next adjacent and communicating directly with an injector nozzle at one end of the tube; the nozzle has atomizing orifices for spraying the pressure amplified fuel into the engine cylinder. A fuel flow controlling solenoid is provided at the opposite end of the tube and all component parts in the tube between the nozzle and a spring loaded solenoid armature are disposed along a common axis extending longitudinally of the tube. Such parts include a fuel pressure amplification plunger, a hydraulic pumping piston for actuating the plunger, a spool valve shiftable toward and away from the armature and a needle valve normally closing the orifices. Three fuel pressures exist in the injector from time to time, namely medium inlet fuel pressure supplied by the engine fuel pump, low pressure return fuel to the supply tank and highly intensified fuel pressure produced in the nozzle upon energization of the solenoid to insure injection of controlled amounts of fuel into a respective cylinder of the engine notwithstanding the pressure conditions existing in a corresponding cylinder during fuel injection.

21 Claims, 14 Drawing Figures

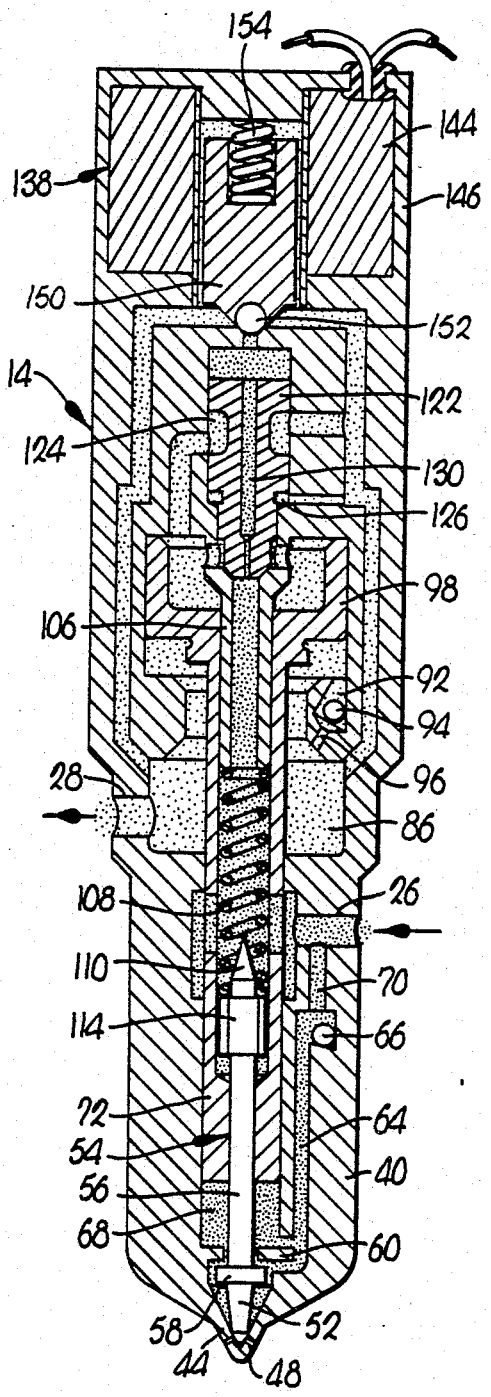
Fig. 4
Fig. 5
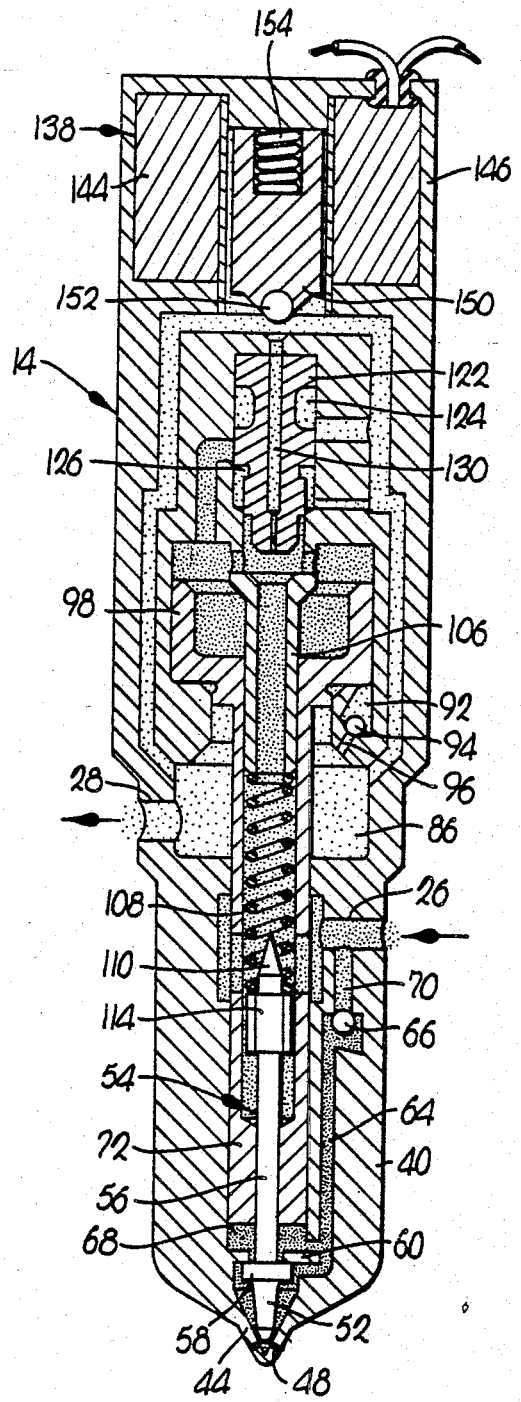

Fig. 11
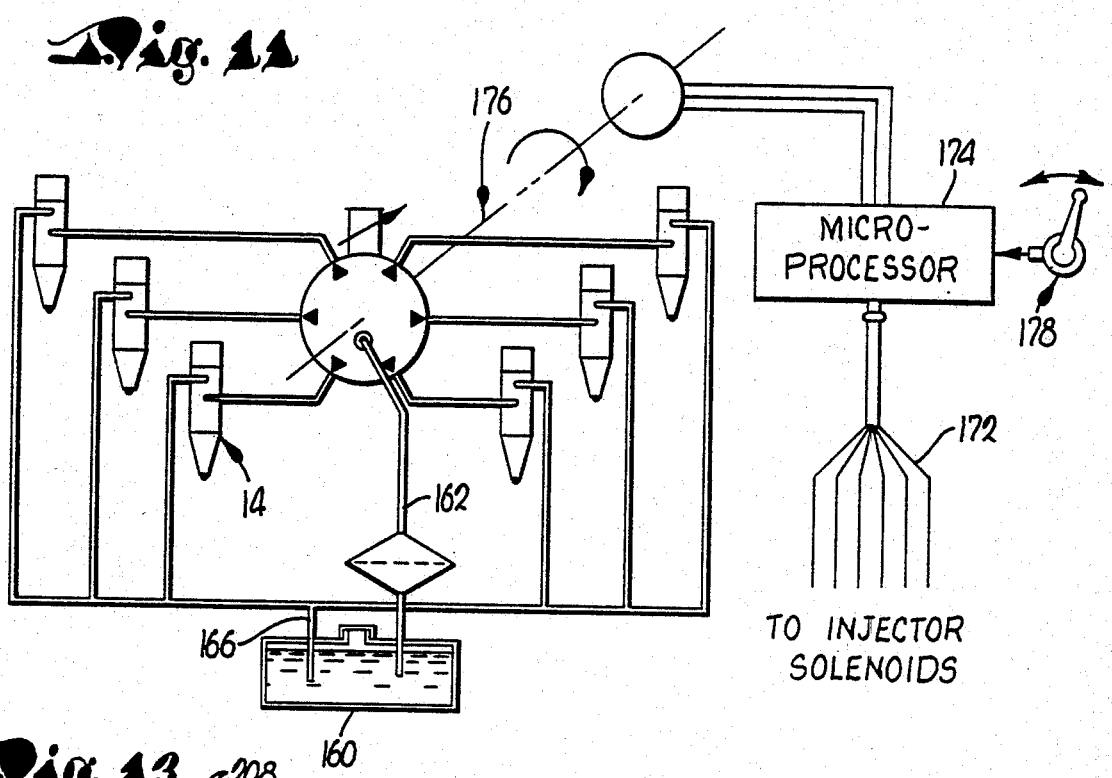
Fig. 13
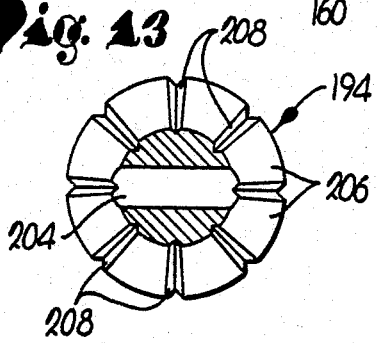
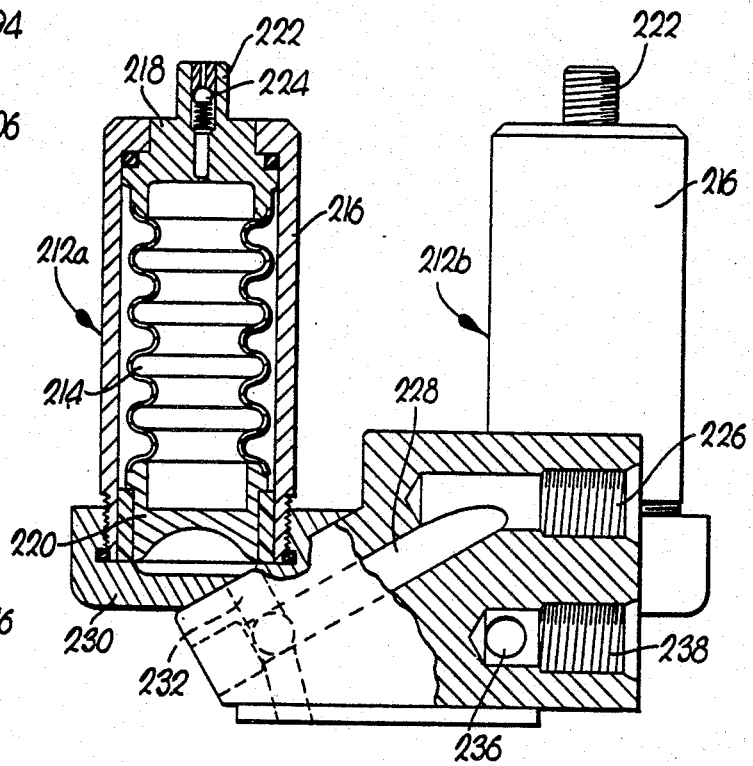
Fig. 9
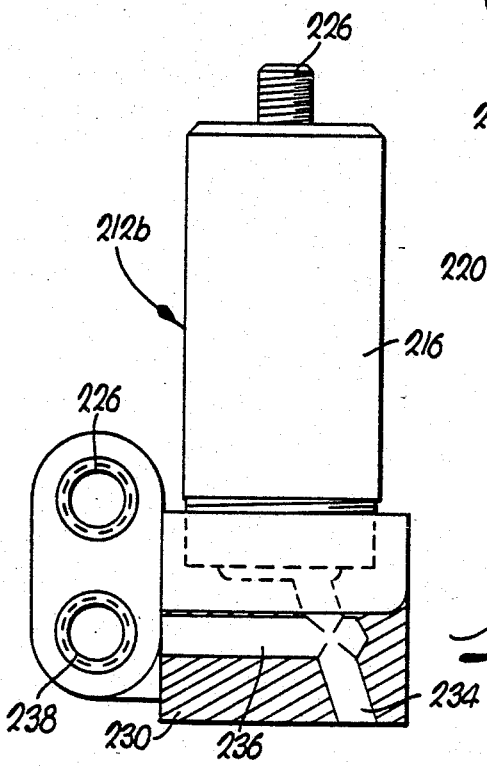
Fig. 10

ELECTRONICALLY CONTROLLED FUEL INJECTION SYSTEM FOR DIESEL ENGINE

The present invention relates to an electronically controlled, hydraulic fuel injection system for internal combustion ignition engines, including a fuel injector for each engine cylinder respectively within a common rail system wherein a single engine-operated pump maintains supply fuel pressure for all the injectors in a common header with fuel lines leading to inlet ports of the injectors as well as from the exhaust ports of the injectors back to a fuel tank.

Fuel injection in accordance with my instant invention is taken to mean the direct injection of atomized, highly intensified pressure fuel sprays directly into the engine cylinders throughout at least the first half of the power strokes of the pistons by means of separate injectors carried by the engine head adjacent the air inlet and exhaust valves.

The injection of fuel into a diesel engine in accordance with the concepts of my improved system becomes a precise, split second operation wherein minute quantities of fuel oil are injected into compressed air in the cylinders as a spray to become well mixed with the air and burn instantaneously. The injection is started, completed and the burning completed in a fraction of a second; hence the need to very accurately control fuel flow under the pressure conditions that exist in a diesel engine cylinder.

In my application of an electronic control to diesel powered engines, using microprocessor technology, sensors and actuators, improved engine performance and emissions are accomplished through electronic control of the of each injector respectively which, in turn, determines injection time and fuel quantity. Inputs to the microcomputer from such sensors as a crankshaft operated encoder, throttle demand, manifold air pressure, exhaust gas and temperature sensors, as well as a supply fuel pressure sensor, complete, for the most part, my diesel engine control system.

The injectors for diesel engines are specially designed for improved, accurate performance first and very importantly by location, in combination with a hydraulically actuated plunger, of a fuel pressure amplification chamber as closely as possible to the actual zone of injection from the fuel atomizing nozzle orifices. The fuel pressurization chamber communicates directly with the amplified fuel-receiving bore of the nozzle, eliminating any consequential time delays from the moment pressure amplification commences until the amplified fuel is atomized and sprayed into the engine cylinder, providing, therefore, positive and accurate timing control.

Equally important is the concentric design of the fuel injector wherein all movable parts are reciprocable along a common axis extending longitudinally of the tubular injector housing. Such components include a fuel pressure-actuated spring-loaded needle valve which normally closes the atomizing orifices of the discharge nozzle, an elongated fuel pressure intensifying plunger, a fuel pressure-actuated piston for driving the plunger, a fuel flow controlling spool valve and a solenoid armature controlling fuel flow release which operates upon impulse energization of the solenoid coil to impart an instantaneous, short duration retraction of the armature.

Additional parts and zones of the injector, concentrically surrounding the axis of the tube include a plunger guide adjacent the nozzle and circumscribing the needle valve whose stem and the plunger are relatively slidable; a seal support remote from the nozzle; a ring which presents a cushioned stop for the piston; a ring-receiving sleeve around the piston carrying a closure surrounding concentrically a bushing for slidably receiving the spool valve; and certain fuel flow passages at various locations between the nozzle at one end of the tube and the solenoid at the opposite end.

As distinguished from the prior art with which I am familiar, my electronic control system has improved memory and computing capabilities, which are especially useful in connection with the control of diesel fuel injectors, and all equipment is both simple and relatively inexpensive to manufacture and add to existing engines, either as original installations or as replacements for other control systems.

Eliminated from presently known diesel fuel injection systems are the mechanically operated cams, rocker arms, etc. for the injectors which provide therein timing and metering functions. Conventional fuel pumps now employed on diesel engines are fully compatible with the present electronically controlled injection system but it is recognized that a fuel pump of itself, has no fuel metering or timing capabilities. In addition, no mechanically operated plungers are provided, as in the prior art for raising the fuel pressure sufficiently for spraying. My injector action not only times and pressurizes the fuel but very accurately and precisely meters it to the engine cylinder depending upon conditions being monitored beyond simple throttle demand. Moreover, in my airless or "solid" injection system, I have purposely and advantageously designed away from the use of highly compressed air employed in certain prior art suggestions at the injector to drive the fuel into the combustion chamber in a finely atomized state, eliminating the high-pressure air compressor required for such airinjection principles.

The present system, as differing from others, is not limited in its use to direct injection cam operated engines and is, therefore, adaptable to engines not having such built-in capability. I do not use either a cam-operated or electrically actuated plunger for the injector as heretofore suggested and I eliminate all pneumatic actuation. I avoid periodic transmission of pressurized pulses of fuel to the injectors by buffering high pressure spikes produced in the system.

In the prior art also is the suggestion of using the engine piston compression for producing fuel injection pressure in an accumulator section, not employed in the system of the present invention. No timing chamber and no variable volume fuel accumulator is needed or used in my injector, as heretofore suggested.

The pressure compensated, variable volume fuel pump here employed requires no pressure relief valve regulation, creating excessive fuel heating, a distinct disadvantage in certain prior systems. Moreover, I am able to use but a single solenoid with no need for a second such electric power device for controlling a metering cycle as required in other systems within my present knowledge.

In the drawings:

FIGS. 4 and 5 are schematic views similar to FIG. 3 showing, by stippling the pressures of the fuel content prior to injection (FIG. 4) and during injection (FIG. 5);

FIG. 9 is a view similar to FIG. 7 showing one pair of end buffers;

FIG. 10 is a view similar to FIG. 8 but partially in section showing one of the buffers illustrated in FIG. 9;

FIG. 11 is a schematic view similar to FIG. 1 illustrating a different type of fuel injection system insofar as the fuel pump and fuel rail arrangement are concerned and omitting the buffers and certain other elements illustrated in FIG. 1;

FIG. 13 is a cross sectional view through the tip portion of the nozzle shown in FIG. 12 illustrating the fuel atomizing grooves.

Figure 2:
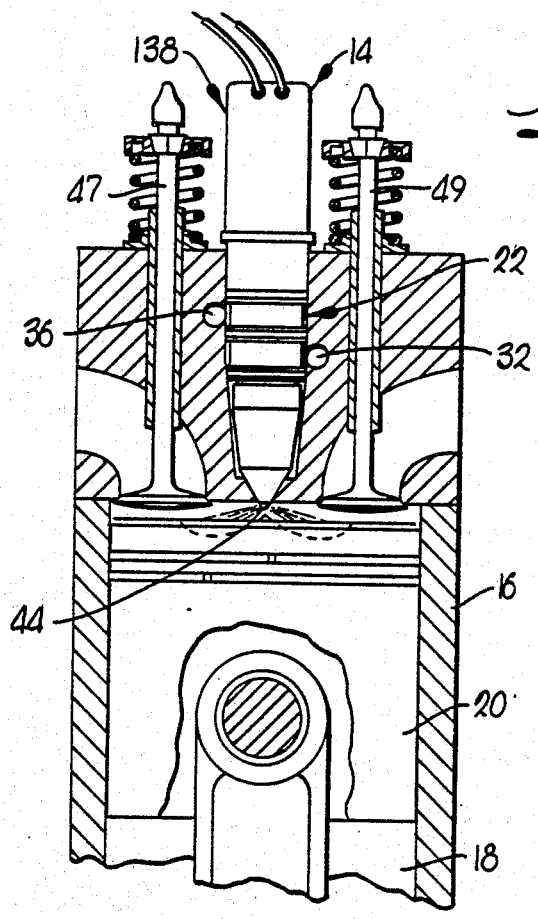
FIG. 2 is a fragmentary cross sectional view of a piston and cylinder assembly of an internal combustion ignition engine showing my novel fuel injector operably associated therewith.
Figure 3:
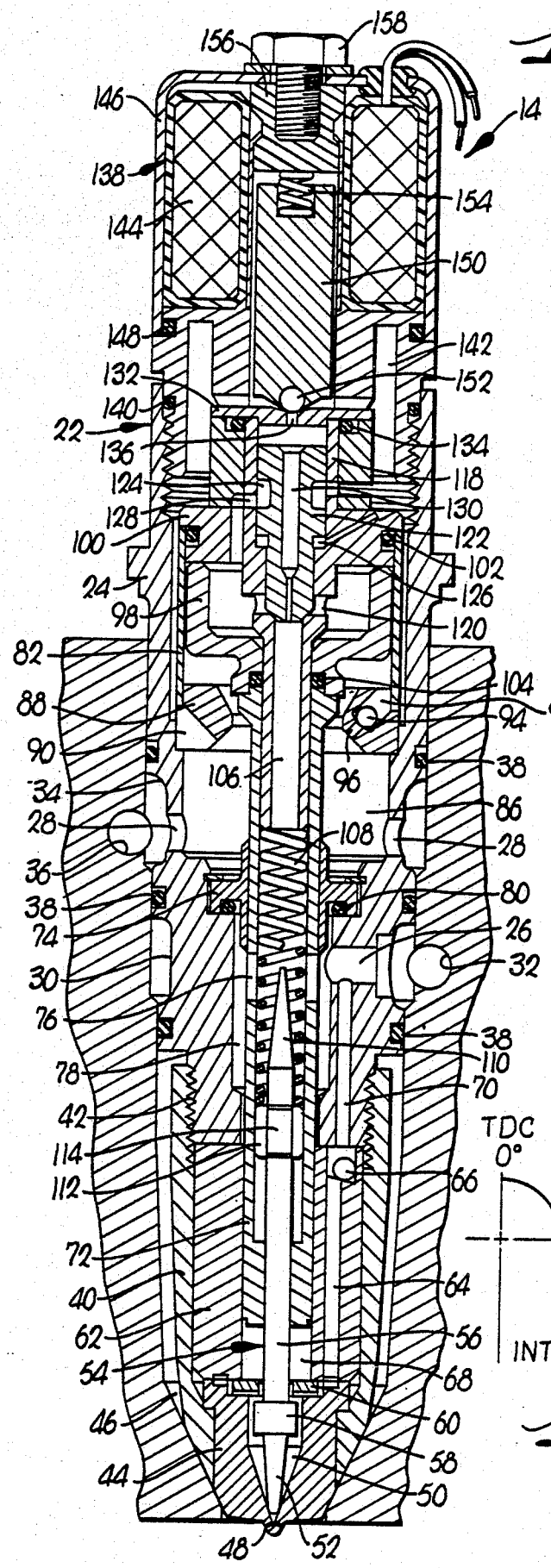
FIG. 3 is an enlarged, longitudinal, cross sectional view of the injector shown in FIG. 2, the he... of the engine block being shown fragmentarily and in cross section.

Referring first to FIGS 2 and 3 of the drawings, a fuel injector 14 is shown in the normal mounted position thereof in a block 16 which comprises the casting that contains the cylinders of a combusion ignition engine, one such cylinder being illustrated and designated by the numeral 18. FIG. 2 shows the relationship of the injector 14 to the cylinder 18 and to its piston 20 reciprocable therein toward and away from the injector 14.

The injector 14 includes a tubular body 22 having a main, open ended section 24 provided with a fuel inlet port 26 and a number of fuel exhaust ports 28. The port 26 communicates with an inlet groove 30 surrounding the section 24 which, in turn, receives fuel from an inlet passage 32 in the block 16. Similarly, the ports 28 communicate with an exhaust groove 34 surrounding the section 24 which, in turn, discharges fuel into an exhaust passage 36 in the block 16. The section 24 carries a series of seals 38 therearound which engage the wall of the cylinder 18 as is clear in FIG. 3.

The body 22 has a secondary open ended section 40 releasably attached to the section 24 by screw threads 42, and containing at its outer end a fuel injection nozzle 44 which, as in the case of the section 40, is tapered for both to fit tightly within a complementally-shaped cavity 46 in the block 16 communicating with the cylinder 18. The nozzle 44 is provided with a plurality of very small fuel atomizing orifices 48 disposed to inject amplified pressure, atomized fuel into the cylinder 18 as depicted in FIG. 2, it being understood that atomization takes place by virtue of such nature of the orifices 48 in conjunction with the high pressure condition of the fuel being injected. Also illustrated in FIG. 2 are the spring loaded valves 47 and 49 for controlling the admission of air into and exhaustion of air from the cylinder 18.

The nozzle 44 is provided with a bore having a conical portion 50 from which amplified pressure fuel is discharged at its apex to the orifices 48, and normally seated in the portion 50 in closing relation to the orifices 48 is a tapered plug 52 of a needle-point valve 54 provided with a stem 56, enlarged at 58 within the bore of the nozzle 44. The valve 54 is reciprocable along the longitudinal axes of the body section 40 and the nozzle 44 and passes through a stop washer 60 engageable by the enlargement 58 for limiting the extent of movement of the plug 52 away from the apex of the nozzle 44.

Interposed tightly between the proximal end of the body section 24 and the washer 60 within the body section 40, clamping the washer 60 against the nozzle 44 and holding the nozzle 44 snugly in place, is a cylindrical guide 62 provided with a longitudinal passage 64 which communicates at one end with the bores of the guide 62 and the nozzle 44. The guide 62 also houses a ball check 66 at the opposite end of the passage 64, and that end of the bore of the guide 62 next adjacent the bore of the nozzle 44 presents a fuel pressure amplification chamber 68 communicating directly with the nozzle 44. Noteworthy are the fuel flow clearances around and beneath the washer 60 as well as around the stem 56. A passage 70 in the body section 24 places the port 26 into communication with the passage 64 when the ball check 66 is open.

A tubular fuel pressure amplification plunger 72, reciprocable along the longitudinal axis of the body 22, and slidable within the bore of the plunger guide 62, has that end thereof next adjacent the chamber 68 closed except for a clearance therethrough for the stem 56, operating to guide the latter. Hence, the stem 56 and the plunger 72 are relatively slidable.

The plunger 72 is also slidable within a seal-supporting member 74 releasably mounted in the body section 24 between the port 26 and the ports 28, and has a pair of diametrically opposed apertures 76 which communicate with a space 78 surrounding the plunger 72, extending from the guide 62 to a seal 80 around the member 74, and communicating with the port 26. The seal 80 precludes flow of fuel from the space 78 around the member to a compartment 86.

That end of the plunger 72 remote from the chamber 68 is normally surrounded by a relatively thin-walled, cylindrical sleeve 82 within the section 24. The sleeve 82 is surrounded by a space 84 which communicates with the compartment 86 in the section 24 from which fuel is exhausted to the ports 28. Tightly fitted into one end of the sleeve 82 and tightly fitted into the section 24 adjacent the compartment 86 is a ring 88 having a series of inclined peripheral slots 90 communicating with the space 84 and with the compartment 86. A cushioning socket 92 in the ring 88, registering with the interior of the sleeve 82, contains a ball check 94 adapted to preclude drainage of fuel from the socket 92 to the compartment 86 through a small hole 96 in the ring 88.

The sleeve 82 contains a cup-shaped piston 98 reciprocable along the longitudinal axis of the section 24 between the ring 88 and a closure 100 for the sleeve 82, sealed by an O-ring 102. As is clear in FIG. 3, the ring 88 and the closure 100 spaced therefrom serve as limiting means in the body 22 for controlling the extent of reciprocation of the piston 98. The piston 98 and the plunger 72 have a tongue and socket interfit sealed by an O-ring 104 surrounding the plunger 72 and surrounded by the piston 98. As noted, the plunger 72 is shouldered at the O-ring 104 such that movement of the piston 98 away from the closure 100 will force the plunger 72 toward the washer 60. However, direct piston-to-plunger abutment and omission of the O-ring 104 will be satisfactory under certain conditions.

A short tube 106 rigid to the closure 100 and slidably receiving the piston 98, extends through the O-ring 104 and into the plunger 72 such as to slidably receive the latter. A coil spring 108 in the plunger 72 abuts the tube 106 and operates to yieldably bias the valve 54 toward the closed position in relation to the orifices 48. To this end, a tapered follower member 110 for the spring 108 extends into the latter and engages the stem 56. The member 110 has a series of grooves 112 spaced around the periphery of an enlargement 114 on the member 110 slidable in the plunger 72 and against which the spring 108 abuts.

The closure 100 is interposed between the piston 98 and a collar 116 in the section 22, and the collar 116, rigid to the closure 100, receives a bushing 118 which is rigid to the tube 106 and terminates at a series of spaced, radial openings 120 in the tube 106 surrounded by the piston 98. A spool valve 122, slidable in the bushing 118 along the longitudinal axis of the body 22, has a diameter greater than the inside diameter of the tube 106, and is adapted to block the flow of fuel between the tube 106 and the piston 98 via the openings 120.

The valve 122 has a number of lands which present a pair of spaced channels 124 and 126 therearound. When the valve 122 is in blocking relationship to the openings 120, the channel 124 is aligned with a series of holes 128 in the bushing 118 which communicate with the piston 98 through the collar 116 and the closure 100 as well as with the section 24 exteriorly of the collar 116 through the latter. And, in such position of the valve 122, the channel 126 communicates with the section 24 exteriorly of the collar 116 through the closure 100. The valve 122 is also provided with a central conduit 130 provided with a reduced diameter stretch normally adjacent the openings 120 and facing the interior of the tube 106.

A disk 132, fitted in the bushing 118, spans the collar 116 as well as a seal 134 within the collar 116 surrounding fthe bushing 118, and a central perforation 136 in the disk 132 is aligned with the axis of the bushing 118 as well as with the conduit 130.

A solenoid 138 is screw threaded into the section 24 and a seal 140 is interposed between the solenoid 138 and the section 24, there being an annular slot 142 in the solenoid 138 which continues along the disk 132 and the collar 116 therearound, opening in spaced relationship to the closure 100. The solenoid 138 has a coil 144 disposed within a shell 146, sealed at 148, and surrounding an elongated armature 150 which is reciprocable along its longitudinal axis toward and away from the disk 132, such axis being aligned with the axis of the body 22.

The armature 150 carries a ball check 152 which is yieldably biased against the disk 132 in closing relationship to the perforation 136 by a coil spring 154 interposed between the armature 150 and a plug 156 which receives a fastener 158 for the shell 146.

Figure 1:
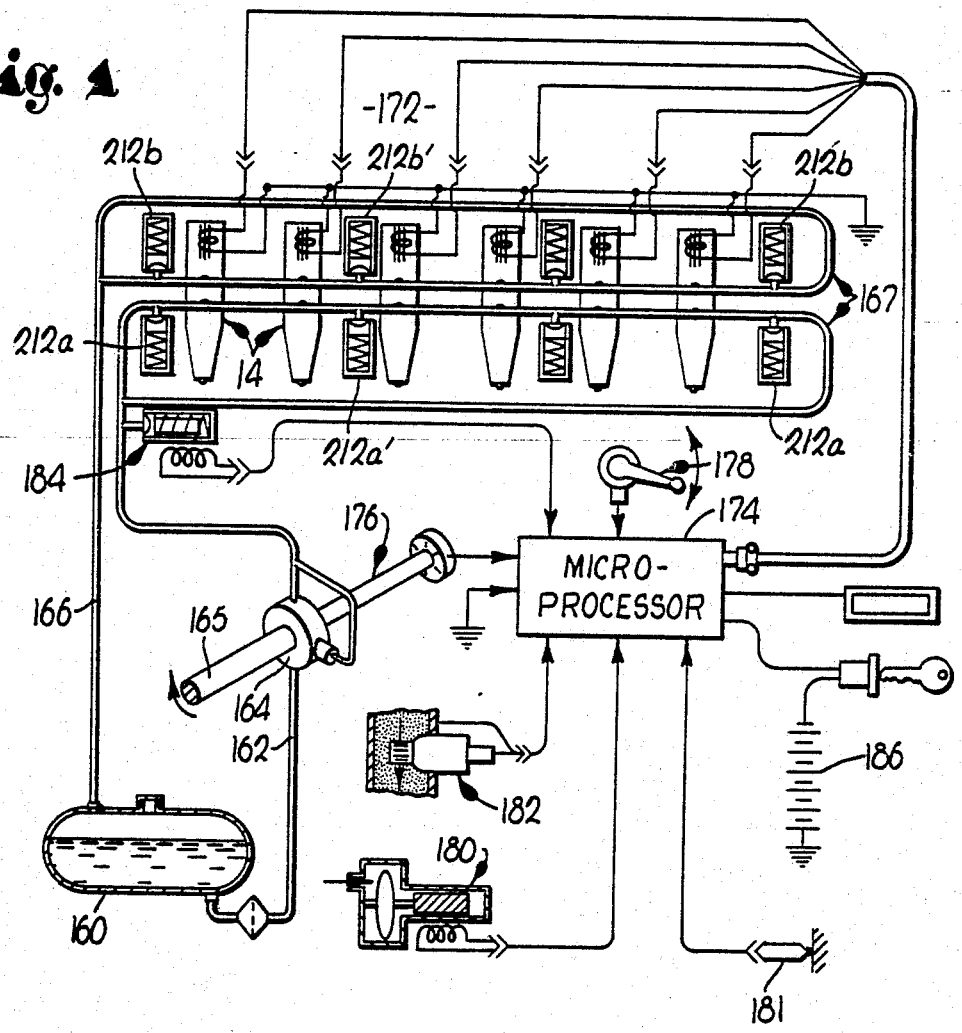
FIG. 1 is a schematic view of the electronically-controlled fuel injection system of my present invention showing a series of injectors and their corresponding pressure spike buffers.

While the above description of my present invention has been limited to but a single injector 14 in reference to FIGS. 2 and 3, it is, of course, contemplated that each of a number of engine cylinders 18 will be equipped with an injector 14 as shown by FIGS. 1 and 11 which illustrate the engine-controlled arrangement for delivering the fuel to the inlet ports 26 of the injectors 14.

Referring to FIG. 1, a fuel tank 160 has a fuel-receiving line 162 (in which is interposed a piston type, pressure compensated, variable volume, flow controlled pump 164) and a fuel return line 166 coupled with the exhaust ports 28. Through use of a common rail system 167, the single pump 164 maintains injection pressure in the common header from which branch lines 168 and 170 lead to and from the ports 26 and 28 respectively. Hence, as distinguished from individual pump systems wherein the pumps do not meter the fuel, it is necessary that the injectors 14 be electronically operated, in preference to mechanical operation (as by cams, rocker arms, etc.) to provide timing, metering, and fuel pressurizing functions.

Thus, it is now clear that each injector 14 has its own pressure actuated plunger 72 to raise the fuel pressure sufficiently for spraying and that the amount of fuel injected essentially becomes a function of the energization pulse length of the solenoids 138, i.e. the period of time the coils 144 remain energized. As is also clear in FIGS. 1 and 11 the coils 144 are coupled in parallel and provided with a common ground through use of an electrical circuit broadly designated by the numeral 172.

Briefly describing the schematics of FIGS. 1 and 11 still further, a properly preprogrammed electronic microprocessor 174 receives sequential electronic pulses from a rotary encoder 176 which is rotated at a speed correlated with that of engine driven shaft 165. Contrary to the capabilities of conventional mechanically controlled injectors for diesel engines, the microprocessor of the electronic control of the present system may be programmed in accordance with known principles in the microprocessor art to vary the time of energization of respective injector solenoids from a value for example of up to approximately 110° before top dead center (TDC) to exactly at or shortly after a corresponding piston has reached TDC. The processor 174 computes the proper injection angle for optimum performance by analyzation of the various parameters, for example, throttle demand at 178, manifold air pressure at 180, exhaust gas oxygen level at 182, exhaust temperature at 181 and pressure sensor 184 in the system 167 controlling engine speed to maintain the proper fuel pressure levels at injector inlet ports 26.

The processor 174 then delivers individual direct current pulses from a battery 186 in the proper firing order through the electric conductors of circuit 172 to the coils 144 of solenoids 138 at a time pulse length conducive to the most economic fuel performance, considering the demand conditions and the aforementioned input parameters which are scanned by the processor 174 at the rate, for example, of every 20 to 50 milliseconds.

Reference is now made to the schematics (FIGS. 4 and 5) of the injector 14 shown in FIGS. 2 and 3 wherein the pressure of the fuel supplied through the inlet port 26 is indicated by medium density stippling, the pressure of the return or exhaust fuel discharged from ports 28 is represented by low density stippling and the pressure of fuel injected into the cylinder 18 is schematically depicted by high density stippling. FIG. 2 illustrates the approximate position of piston 20 at the initiation of the injection cycle, depending upon what operative commands are being given out at that instant in time by the electronic control system including processor 174.

During the static condition (FIG. 4) as also in FIG. 3 of a particular injector 14, the solenoid 138 is deenergized, causing the spring 154 to hold the ball check 152 against the disk 132, closing the perforation 136. Hence, with the plug 52 closing the orifices 48, the pressurized fuel (medium density stippling) at and from the inlet port 26 is entrapped within the space 78, the passages 64 and 70, the nozzle 44, the chamber 68, the interiors of the plunger 72 and the tube 106, the conduit 130, within the bushing 118 between the valve 122 and the disk 132 and within the perforation 136.

On the other hand, at the moment of closing of the perforation 136 and the orifices 48, exhaust fluid (low density stippling) not yet fully returned via ports 28 to the tank 160 will be contained in certain other areas and zones of the injector 14. They include the compartment 86, the slots 90, the hole 96, the socket 92, the interior of the ring 88, the space 84, the interior and exterior of the piston 98, the openings 120, the channels 124 and 126, the holes 128, the slot 142, the zone surrounding the armature 150 and the space between the armature 150 and the plug 156, including the socket within the armature 150 which receives the spring 154.

As shown in FIG. 5, during the short duration actuation of the solenoid 138 and injection of the fuel spray from the small diameter orifices 48 into the cylinder 18, the energization of the coil 144 will shift the armature 150 against the action of the spring 154, compressing the latter and displacing the fuel which had filled the space between the armature 150 and the plug 156.

As the ball check 152 opens the perforation 136, the fuel escapes via perforation 136 from the bushing 118 to the slot 142, the space 84 and compartment 86. Therefore, the fuel at inlet pressure in the zone between the valve 122 and disk 132 can no longer maintain the valve 122 closed with respect to openings 120, and the valve 122 shifts into engagement with the disk 132, because of the fuel (at inlet pressure) acting on the smaller end of the valve 122 at the openings 122. Contrast FIG. 4 showing the valve 122 held against the tube 106 because of the area differential between the ends of the valve 122.

To be noted also is the small diameter dimension of the conduit 130 at the tube 106 in comparison with the diameter of the perforation 136, causing a pressure drop across the smaller end of the valve 122 and assuring its instantaneous and rapid, full shifting to the position shown in FIG. 5. Movement of the channels 124 and 126 has no effect on their fuel content at exhaust pressure, but fuel inlet pressure to the channel 124 from the interior of the piston 98 is now momentarily blocked.

Therefore, as noted in FIG. 5, the fuel at inlet pressure flows from within the tube 106 into the piston 98 via the openings 120, forcing the piston 98 and the plunger 72 toward the nozzle 44, causing the plunger 72 to amplify the pressure of the fuel in the chamber 68. Such pressure intensification also exists in the nozzle 44, including its portion 50, as well as in the passage 64, but cannot escape from the latter because of the closing of the passage 70 by the ball check 66 under the influence of the pressure in the passage 64 which greatly exceeds the pressure in the passage 70.

The high pressure in the nozzle 44, acting on the plug 52, which greatly exceeds the fuel inlet pressure in the plunger 72 and in the tube 106 acting on the stem 56, causes the valve 54 to shift, against the action of the spring 108, to open the orifices 48. Also, the surface area of the tapered portion plug 52 against which the intensified fuel pressure acts exceeds the surface area of the inner end of the stem 56 at the follower member 110 against which the fuel at inlet pressure acts, thereby causing the force of the spring 108 to be easily and quickly overcome as the plunger 72 amplifies the pressure of the fuel in the chamber 68.

In preferred embodiments of my invention, the fuel pressure amplification components of injector 14 should be sized and constructed to increase the pressure of the fuel from about 8:1 to about 10:1 above the fuel pump pressure. In this respect, diesel engine fuel pumps in general usage provide output pressures in the range of about 500 p.s.i.g. to about 1500 p.s.i.g. Exemplary only and for purposes of comparison and full understanding of the above, the fuel pressure in the zones designated by medium density stippling may be in the order of about 1500 p.s.i.g. whereas the pressure in the exhaust zones (low density stippling) will not usually exceed more than about 2–3 p.s.i.g. The plunger 72, on the other hand, can readily increase the fuel pressure from 1500 p.s.i.g. to at least as high as 12,600 p.s.i.g.

At this juncture it is important to recognize the novel manufacturing and operational advantages of orienting for reciprocation along the longitudinal axis of the body 22 all of the reciprocable components which include the valve 54 and its stem 56, the member 110, the plunger 72, the piston 98, the valve 122 and the armature 150, including its ball check 152. Located also on such axis are the springs 108 and 154, the tube 106 and the bore 130. Moreover, concentric to the body axis are the nozzle 44, the guide 62, the bushing 74, the ring 88, the sleeve 82, the closure 100, the collar 116 and the coil 114, as well as the grooves 34 and 36, the space 84 and the slot 142, with the conduit 130, the perforation 136 and the opening in the washer 60 located on that same axis.

Figure 12:
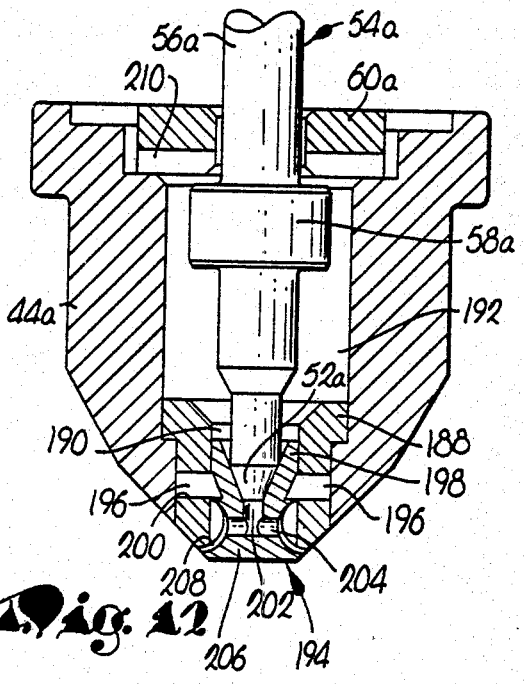
FIG. 12 is an enlarged, fragmentary, cross sectional view similar to a portion of FIG. 1 but showing a modified nozzle.

While it is contemplated that the nozzle 44 will accommodate most relatively heavy petroleum fuels and assure spontaneous ignition of the air fuel mixture in the cylinder 18, for use with diesel fuels containing coal or a coal slurry and other alternate fuels, a special nozzle 44*a* is shown in FIG. 12 containing a press-fitted, disposable shell 188, preferably made from a sintered metal, such as tungsten carbide, and having a bore 109 therethrough aligned with the axis of a bore 192 in the nozzle 44*a*.

The bore 190 receives a disposable tip 194, which may be made from the same wear resistance material as the shell 188, and held in place by a pair of opposed, removable, radial pins 196 traversing the shell 188 and engaging the outer surface of a frustoconical portion 198 of the tip 194 against an inwardly facing shoulder 200 surrounding the tip 194.

The tip 194 has a central port 202 at the apex of the portion 190 which communicates with a transverse opening 204 in a substantially hour glass shaped portion 206 of the tip 194. A series of fuel atomizing orifices in the nature of grooves 208 in the portion 206 are spaced around the latter for receiving fuel from the outer surface of the portion 206, as fed thereto by the opening 204, and spraying the intensified, atomized fuel into the cylinder 18 (see also FIG. 13).

Essentially the same as is illustrated in FIG. 3, a reciprocable valve 54*a* is shiftable into and out of closing relationship to the port 202 and has a plug 52*a* conforming to the internal shape of the portion 198 of the tip 194. FIG. 12 also shows the clearance around stem 56a of stop washer 60a, the clearance at the periphery of the washer 60a and clearance grooves 210 in the washer 60a above enlargement 58a on the valve 54a.

In a system for assuring a constant supply of fuel at requisite pressure to all of the ports 26, a piston type of pump 164 may be advantageously used. As shown in FIGS. 1 and 6–10, there is provided a series of spike buffers operating as cushions against the shock of pressure fluctuations which would otherwise exist in the injectors 14. Such spikes in the rail system 167 are the result of timing the power strokes of the pistons 20, it being understood, of course, that all the injectors do not receive and inject fuel simultaneously. Thus, a series of high, sharply defined fuel pressures or spikes of short duration continue to exist in the rail system 167 during operation of the engine.

Each buffer includes a volute-form bellows 214, preferably of metallic material, capable of expansion and contraction in response to variations in fuel pressure directed thereto. The bellows 214 is housed in a cylindrical casing 216 having an end closure 218 and a piston 220 reciprocable toward and away from the closure 218. Nitrogen or other suitable gas is maintained at a pressure, for example, of 300–500 p.s.i.g. in the bellows 214, introduced through a core 222 in the closure 218 and having a spring-loaded check valve 224 therein. The bellows 214 is rigidly secured in sealed relation to both the closure 218 and the piston 220.

Figure 6:
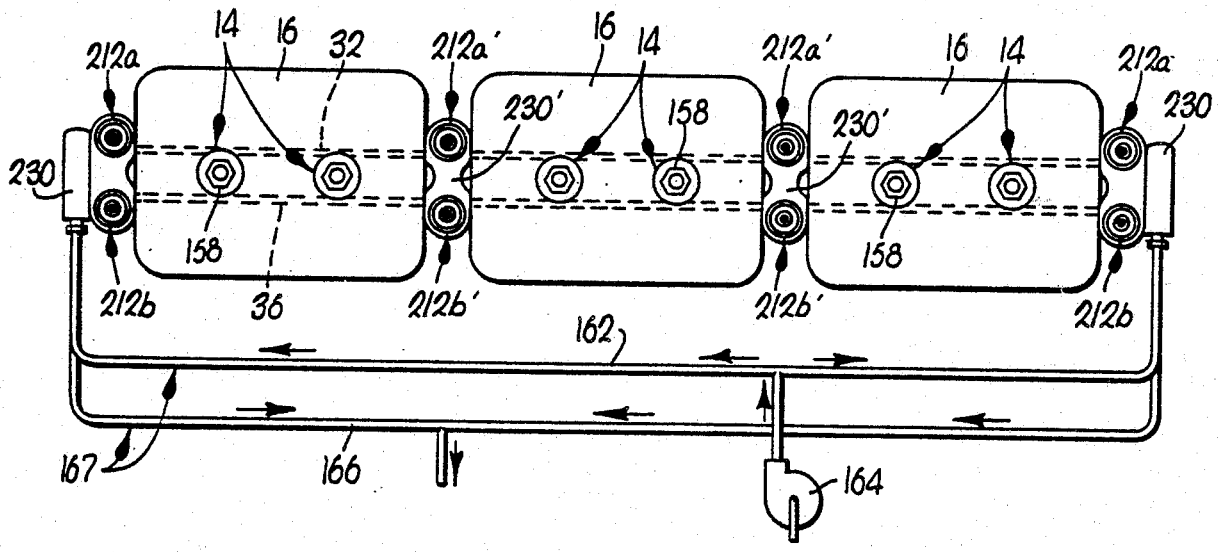
FIG. 6 is a top plan view, showing schematically, three engine heads of a six cylinder engine, together with the fuel flow pattern through the heads in association with the crankshaft-controlled pump and its associated lines.

As shown in FIGS. 1 and 6, the buffers 212 are arranged in pairs in relation to the series of injectors 14 and the rail system 167, including buffers 212a and 212b at each end of the system 116, each such pair being related to one injector 14, and intermediate buffers 212a' and 212b', each of the latter pairs being related to two injectors 14. While all the buffers are the same insofar as the above described components are concerned, the end buffers 212a and 212b have associated therewith a common casting 230 which is slightly different from castings 230' common to each pair of intermediate buffers 212a' and 212b'.

Referring first to one pair of end buffers 212a and 212b and their common casting 230 shown in FIG. 9 and to one of the buffers 212b and the casting 230 shown in FIG. 10, an inlet 226 in the casting 230 is connected to the line 162 such that the fuel from the pump 164 flows along a branch 228 in the casting 230, thence to and from the piston 214 of the buffer 212a and thereupon to the passage 32 through an opening 232 communicating with the branch 228.

The corresponding buffer 212b has an inlet 234 in the casting 230 for receiving exhaust fuel from the passage 36, such fuel flowing to and from the piston 214 of the buffer 212b and then along a branch 236 in the casting 230 to an outlet 238 in the casting 230 and thereupon to the line 166 for return to the tank 160.

Figure 8:
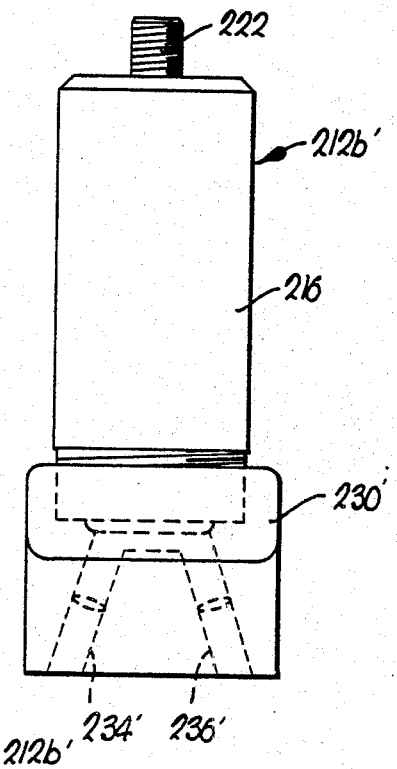
FIG. 8 is an end view of one of the buffers shown in FIG. 7.
Figure 7:
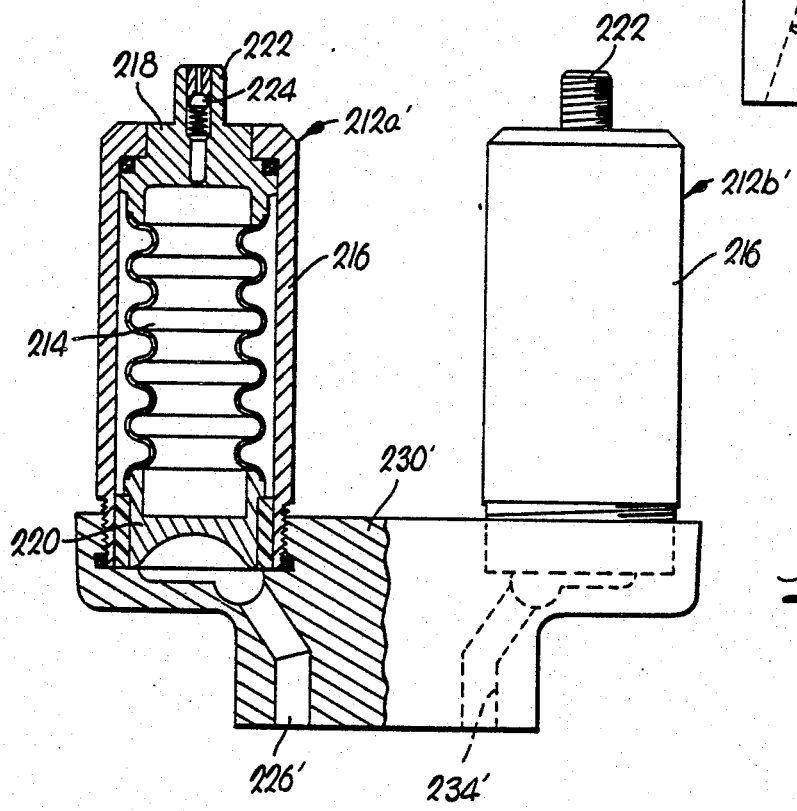
FIG. 7 is an enlarged, elevational view, partially in section, showing one of the intermediate pairs of buffers illustrated schematically in FIG. 1.

The castings 230' (FIGS. 7 and 8) for each pair of buffers 212a' and 212b' are also provided with passages for flow of fuel to and from the corresponding pistons 220 and for the same purpose as above described. In FIG. 8 the flow to the piston 220 of the buffer 212b' is through an inlet 234' in the casting 230', the latter having a fuel outlet 236'. Only the fuel outlet 226' is shown for the buffer 212a' in FIG. 7.

FIG. 11 illustrates a slightly modified version of the present invention in which injectors 14 are as previously described but the microprocessor 174 is programmed to control flow of fuel to injectors from a fuel pump having individual outlet ports leading to the inlet of a corresponding injector 14.

Figure 14:
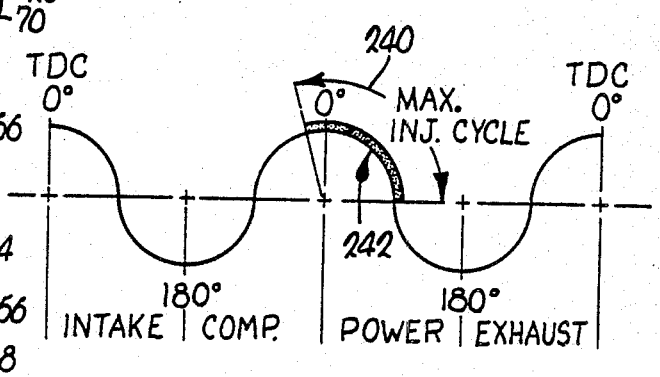
FIG. 14 is a diagram of a complete cycle of the piston illustrating the onset of fuel injection and its duration.

FIG. 14 of the drawings illustrates diagrammatically, by arrow 240, that portion of the full cycle of the piston 20 during which fuel may be injected into the cylinder 18. No fuel is injected during the intake or exhaust strokes of the piston 20 but for representative purposes only, as indicated by a 105° arc 242 injection commences during the latter portion of the compression stroke prior to the piston 20 reaching top dead center (TDC). Injection then continues during the power stroke from top dead center until the cylinder completes the first half of its power stroke, all as timed by the electronic control shown in FIGS. 1 and 11 which includes the microprocessor 174.

The significance from an operational and economy standpoint of precise and accurate control of fuel delivery to the cylinders of a diesel engine by provision of an electronic control system therefor can be better appreciated and understood when it is recognized that at prevailing diesel fuel prices, savings of the order of one-half mile per gallon for over the road tractor-trailer rigs represent an economic improvement in operational efficiency which in a matter of a few months more than makes up for the installation cost of the electronically controlled injection equipment of this invention. In fact, under most conditions, the system described herein will demonstrate economies which greatly exceed the one-half mile per gallon improvement standard. This can readily be demonstrated by multiplying the fuel savings inherent in an increase in typical mileage per gallon of for example 5.5 m/g to 6.0 m/g on a yearly mileage figure of 150,000 miles or more.

I claim:

1. In a fuel injector, a tubular body having a fuel inlet port for receiving a constant supply of pressurized fuel and a fuel exhaust port, each disposed intermediate the ends of the body;

a fuel injection nozzle secured to the body at one of said ends and having fuel atomizing orifice means;

valve means reciprocable in the body along the longitudinal axis of the body toward and away from the orifice means and normally closing the latter;

means presenting a fuel pressure amplification chamber in the body adjacent the nozzle and communicating directly therewith;

a fuel pressure amplifying plunger extending from the chamber toward the opposite of said ends and reciprocable in the body along said axis toward and away from the orifice means;

blocking means normally precluding flow of fuel from the inlet port to the exhaust port;

selectively operable power means associated with said body, said blocking means being releasable upon actuation of the power means; and structure in the body operable upon said actuation of the power means for forcing the valve away from the orifice means to open the latter and forcing the plunger toward the orifice means in response to the pressure of fuel in the body whereby to amplify the fuel pressure in the chamber and to spray the pressure amplified, atomized fuel emanating from the orifice means into a cylinder of an internal compression ignition engine, said chamber being located next adjacent the orifice means in the nozzle to cause fuel to be injected into the cylinder of said engine through the orifice means upon actuation of the power means without significant time delay following actuation of said power means and consequential unblocking of the orifice means.

2. The invention of claim 1, the nozzle having a shell releasably attached thereto and containing a tip provided with a discharge port adapted for closing of the valve, the orifice means being a series of discharge grooves in the tip communicating with the port of the tip, the shell and the tip being of wear resistant material.

3. The invention of claim 1; and buffer means for maintaining the fuel supply at a predetermined pressure level in the inlet port.

4. The invention of claim 1; there being a fuel supply line for the inlet port and a fuel return line for the exhaust port, there being buffer means in each said lines.

5. The invention of claim 1, said fuel pressure amplifying plunger being operable to increase the pressure of the fuel in said chamber from about 8 to about 10 times the inlet fuel pressure to said body.

6. The invention of claim 1, said power means being a single solenoid carried by the body at said opposite end, said solenoid having an armature spaced away from the plunger and reciprocable toward and away from the latter along an axis aligned with said axis of the body, the blocking means being releasable upon energization of the solenoid to retract the armature.

7. The invention of claim 6, said structure including means responsive to the amplified pressure of fuel in the chamber for blocking the flow of the amplified fuel from the chamber to the inlet port.

8. The invention of claim 7, said solenoid having resilient means yieldably biasing the armature away from the plunger.

9. The invention of claim 8, said structure including resilient means in the body yieldably biasing the valve means toward the orifice means.

10. The invention of claim 9, said structure including a plunger-engaging piston reciprocable in the body along said axis of the latter toward and away from the orifice means for forcing the plunger toward the orifice means in response to the pressure of fuel in the body when the solenoid is energized.

11. In a fuel injector, a tubular body having a fuel inlet port for receiving a constant supply of pressurized fuel and a fuel exhaust port, each disposed intermediate the ends of the body;

a fuel injection nozzle secured to the body at one of said ends and having fuel atomizing orifice means;

valve means reciprocable in the body along the longitudinal axis of the body toward and away from the orifice means and normally closing the latter;

means presenting a fuel pressure amplification chamber in the body adjacent the nozzle and communicating directly therewith;

a fuel pressure amplifying plunger extending from the chamber toward the opposite of said ends and reciprocable in the body along said axis toward and away from the orifice means;

blocking means normally precluding flow of fuel from the inlet port to the exhaust port;

selectively operable power means associated with said body, said blocking means being releasable upon actuation of the power means; and structure in the body operable upon said actuation of the power means for forcing the valve away from the orifice means to open the latter and forcing the plunger toward the orifice means in response to the pressure of fuel in the body whereby to amplify the fuel pressure in the chamber and to spray the pressure amplified, atomized fuel emanating from the orifice means into a cylinder of an internal compression ignition engine, said power means being a single solenoid carried by the body at said opposite end, said solenoid having an armature spaced from the plunger and reciprocable toward and away from the latter along an axis aligned with said axis of the body, the blocking means being releasable upon energization of the solenoid to retract the armature, said structure including means responsive to the amplified pressure of fuel in the chamber for blocking the flow of the amplified fuel from the chamber to the inlet port, said solenoid having resilient means yieldably biasing the armature away from the plunger, said structure including resilient means in the body yieldably biasing the valve means toward the orifice means, said structure including a plunger-engaging piston reciprocable in the body along said axis of the latter toward and away from the orifice means for forcing the plunger toward the orifice means in response to the pressure of fuel in the body when the solenoid is energized, said structure including a tube rigid in the body and exxtending into the plunger at that end of the latter remote from the chamber along said axis of the body, said piston and said plunger being reciprocable along the tube.

12. The invention of claim 11, said structure including fuel flow controlling valving reciprocable in the body between the plunger and the blocking means along said axis of the body.

13. The invention of claim 12, said structure including a disk rigid in the body between the armature and the valving, said disk having a perforation surrounding said axis of the body, said blocking means including a perforation-closing element carried by the armature for reciprocation therewith.

14. The invention of claim 13, said valving being normally spaced from the disk and normally blocking the flow of fuel from the tube to the piston.

15. The invention of claim 14, said means for biasing the valve means including a coil spring in the plunger between the tube and the valve means.

16. The invention of claim 15, said valving having a conduit extending along said axis for flow of fluid between the tube and the disk.

17. The invention of claim 16; and a follower for the resilient means reciprocable in the plunger along said axis of the body and engaging the valve means, said resilient means abutting the follower.

18. The invention of claim 17, said valve means having a stem engaging the follower and reciprocable in the plunger along said axis of the body.

19. The invention of claim 18; and stop means in the body for limiting the extent of movement of the valve means away from the orifice means, said stem having a shoulder engageable with the stop means.

20. The invention of claim 19; and a pair of spaced movement limiting means in the body for controlling the extent of reciprocation of the piston.

21. The invention of claim 14, said structure having means for cushioning the movement of the piston against one of said limiting means when the piston moves toward the orifice means.

* * * * *